US006408745B1

(12) United States Patent
Topolewski et al.

(10) Patent No.: US 6,408,745 B1
(45) Date of Patent: Jun. 25, 2002

(54) VARIABLE HEIGHT PRINT TABLE ARRANGEMENT FOR A SCREEN PRINTING APPARATUS

(75) Inventors: Anatol Topolewski, Mundelein; Mark Smialek, Bartlett; Eugene Wesolowski, Mundelein, all of IL (US)

(73) Assignee: Anatol Incorporated, Mundelein, IL (US)

( * ) Notice: Subject to any disclaimer, the term of this patent is extended or adjusted under 35 U.S.C. 154(b) by 0 days.

(21) Appl. No.: 09/478,755

(22) Filed: Jan. 6, 2000

(51) Int. Cl.[7] ..... B05C 17/06
(52) U.S. Cl. ..... 101/126; 101/115; 101/123
(58) Field of Search ..... 101/114, 115, 101/123, 124, 126, 129

(56) References Cited

U.S. PATENT DOCUMENTS

| | | | | |
|---|---|---|---|---|
| 4,193,344 A | | 3/1980 | Ericsson | |
| 4,267,773 A | | 5/1981 | Scherp et al. | |
| 4,516,495 A | | 5/1985 | Ericsson | |
| 4,669,377 A | | 6/1987 | Ericsson et al. | |
| 4,715,278 A | | 12/1987 | Ericsson | |
| 4,781,114 A | | 11/1988 | Ericsson | |
| 4,909,145 A | | 3/1990 | Ericsson | |
| 4,976,026 A | * | 12/1990 | Dacey, Jr. | 29/714 |
| 4,989,512 A | | 2/1991 | Lindstrom et al. | |
| 5,209,194 A | * | 5/1993 | Adachi et al. | 123/90.17 |
| 5,626,074 A | * | 5/1997 | Zelko | 101/115 |
| 5,713,277 A | | 2/1998 | Szarka | |
| 5,813,328 A | | 9/1998 | Hamu | |
| 5,845,569 A | | 12/1998 | Tkacz et al. | |
| 5,887,519 A | * | 3/1999 | Zelko | 101/115 |
| 5,913,264 A | * | 6/1999 | Eppinger | 101/115 |
| 6,053,101 A | * | 4/2000 | Hix | 101/126 |

* cited by examiner

*Primary Examiner*—Ren Yan
(74) *Attorney, Agent, or Firm*—Michael H. Minns; Hahn Loeser & Parks LLP

(57) ABSTRACT

A variable height print table arrangement for a screen printing apparatus which includes a plurality of rotatable lower level outwardly extending spider arms which support corresponding support pallets or tables on which apparel or other textile substrates to be screen printed are placed. The rotatable lower level outwardly extending spider arms are lowered and raised using a mechanical drive, such as an electrical servomotor or an electrical stepper motor, which is capable of lowering and raising the rotatable lower outwardly extending level spider arms a predetermined variable distance. The variable height print table arrangement for a screen printing apparatus also includes a counterbalance arrangement, preferably using a compression spring, which reduces the effective weight of the rotatable lower level outwardly extending spider arms and allows a smaller mechanical drive to be used. This results in a screen printing apparatus which is smaller, has less weight and is less expensive to operate than many known prior art screen printing apparatus.

5 Claims, 14 Drawing Sheets

VARIABLE HEIGHT PRINT TABLE ARRANGEMENT FOR A SCREEN PRINTING APPARATUS

BACKGROUND AND SUMMARY OF THE INVENTION

The present invention relates generally to new and novel improvements in a variable height print table arrangement for a screen printing apparatus. More particularly, the present invention relates to a variable height print table arrangement for a screen printing apparatus which is capable of lowering the print tables in a screen printing apparatus a predetermined variable distance to facilitate the screen printing process.

The application of text, logos and other indicia onto apparel, such as tee shirts, sweatshirts and jackets as well as other textile substrates, has become very popular. Fanciful indicia, such as logos, slogans, school names, sports team names and sayings, are commonplace. As a result, screen printing has become very prevalent and large commercial screen printing operations are common today.

Indicia can be printed onto apparel and other textile substrates in one or more colors. Typically, a screen printing apparatus has at least one station for each color to be printed onto the apparel and other textile substrates. For example, a design utilizing two (2) colors will typically have at least two (2) printing stations, one for each color. Similarly, a design utilizing eight (8) colors will typically have at least eight (8) printing stations, one for each color. Each printing station generally includes a printing head which supports a single screen, the ink of the color to be applied at that printing station and a mechanism for applying the ink of the color to be applied to the apparel or other textile substrates. Each color is generally carried by a single screen and the apparel or other textile substrates travel from one printing station to the next printing station by a number of methods, including a chain or rigid arm. The apparel or other textile substrates are generally carried from one printing station to the next printing station by a support pallet or table. In addition to printing stations, there may also be one or more curing stations provided to heat and set the inks placed on the apparel or other textile substrates.

In a turret or carrousel type screen printing apparatus, a center section generally includes a plurality of outwardly extending spider arms. Generally, two (2) levels of outwardly extending spider arms are provided, a stationary upper level which carries the printing heads and screens or the curing assemblies and a rotating lower level which carries the support pallets or tables upon which the apparel or other textile substrates are placed for printing. The stationary upper level outwardly extending spider arms are generally referred to as "stations" and the rotatable lower level outwardly extending spider arms generally rotate from "station" to "station." In particular, the rotatable lower level outwardly extending spider arms typically rotate from one "station" to the next "station" where the printing operations and/or curing operations are carried out.

Prior to rotation of the lower level outwardly extending spider arms to allow the support pallets or tables to move from one "station" to the next "station," the support pallets or tables are typically lowered to avoid interference with the printing heads and curing equipment in the stationary upper level outwardly extending spider arms. This lowering of the support pallets or tables has typically been accomplished by one or more air cylinders which lower each support pallet or table a fixed distance or "stroke" which is not readily adjustable.

However, there are situations where it is desirable to carry out two (2) or more printing and/or curing operations at a single station, for example, to double coat an ink of a certain color. In such situations, the support pallets or tables are lowered the fixed distance or "stroke" by the one or more air cylinders and are again raised at the same station without rotation of the lower level of outwardly extending spider arms. In such situations, the lowering and raising of the support pallets or tables a fixed distance or "stroke" by the one or more air cylinders takes longer than desirable and has a negative impact on the overall efficiency and cycle time of the screen printing operation.

In addition, there are situations where it is desirable to adjust the top and/or the bottom position of the support pallets or tables to accommodate, for example, inks having different characteristics, such as different densities and compositions, apparel or other textile substrates having different characteristics, such as different absorbencies, and printing screens having different characteristics, such as the size and flexibility or rigidity of the printing screens. With known prior art support pallets using one or more air cylinders, the top and bottom positions or "stops" of the fixed distance or "stroke" are generally fixed and are not readily adjustable.

Accordingly, an object of the present invention is the provision of a variable height print table arrangement for a screen printing apparatus which allows the support pallets or tables to be raised and lowered a predetermined variable distance.

Another object of the present invention is the provision of a variable height print table arrangement for a screen printing apparatus which allows the support pallets or tables to be raised and/or lowered to specific predetermined adjustable positions or "stops" in relation to the printing, curing and other processing stations.

Yet another object of the present invention is the provision of a variable height print table arrangement for a screen printing apparatus which includes a counterbalance arrangement which reduces the effective weight of the rotating lower level outwardly extending spider arms and permits the use of a smaller motor having less weight and size and which is less expensive to operate than motors used in many known prior art screen printing apparatus or, alternatively, provides faster movement if a motor of the same size is used.

Yet another object of the present invention is the provision of a variable height print table arrangement for a screen printing apparatus in which the rotating lower level outwardly extending spider arms are capable of being selectively indexed to rotate to the next station or to remain at the same station for one or more subsequent operation(s).

These and other objects of the present invention are attained by a variable height print table arrangement for a screen printing apparatus which includes a plurality of rotatable lower level outwardly extending spider arms which support corresponding support pallets or tables on which apparel or other textile substrates to be screen printed are placed. The rotatable lower level outwardly extending spider arms are lowered and raised using a mechanical drive, such as a an electrical servomotor or stepper motor, which is capable of lowering and raising the rotatable lower level outwardly extending spider arms a predetermined variable distance. The variable height print table arrangement for a screen printing apparatus also includes a counterbalance arrangement, preferably using a compression spring, which reduces the effective weight of the rotatable lower level outwardly extending spider arms and allows a smaller mechanical drive to be used. This results in a screen printing apparatus which is smaller, has less weight and is less expensive to operate than many known prior art screen printing apparatus.

Other advantages and novel features of the present invention will become apparent in the following detailed description of the invention when considered in conjunction with the accompanying drawings.

DETAILED DESCRIPTION OF THE DRAWINGS

Figure 1:
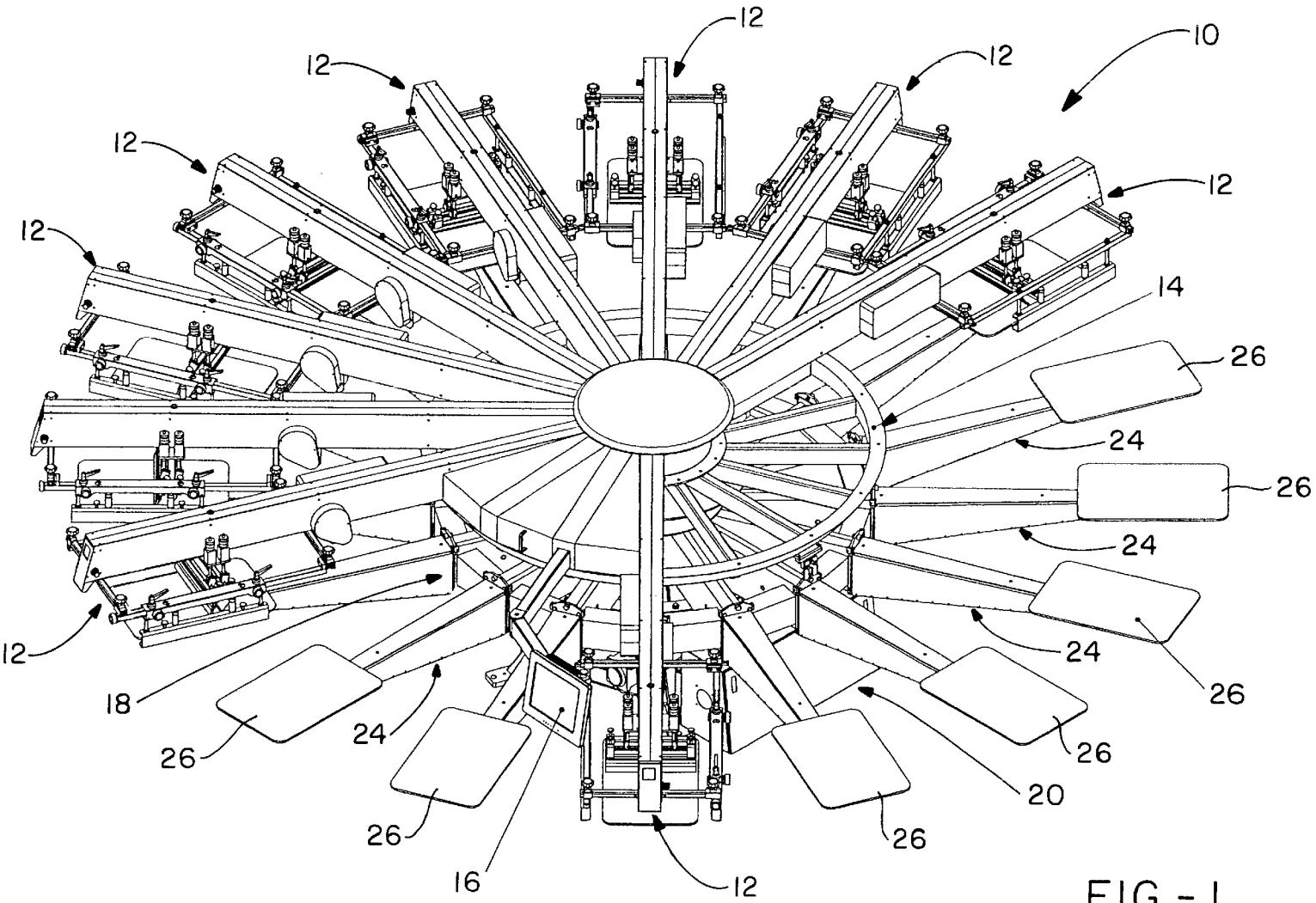
FIG. 1 is a first upper prospective view of a screen printing apparatus having a variable height print table arrangement for a screen printing apparatus in accordance with a preferred embodiment of the present invention.
Figure 2:
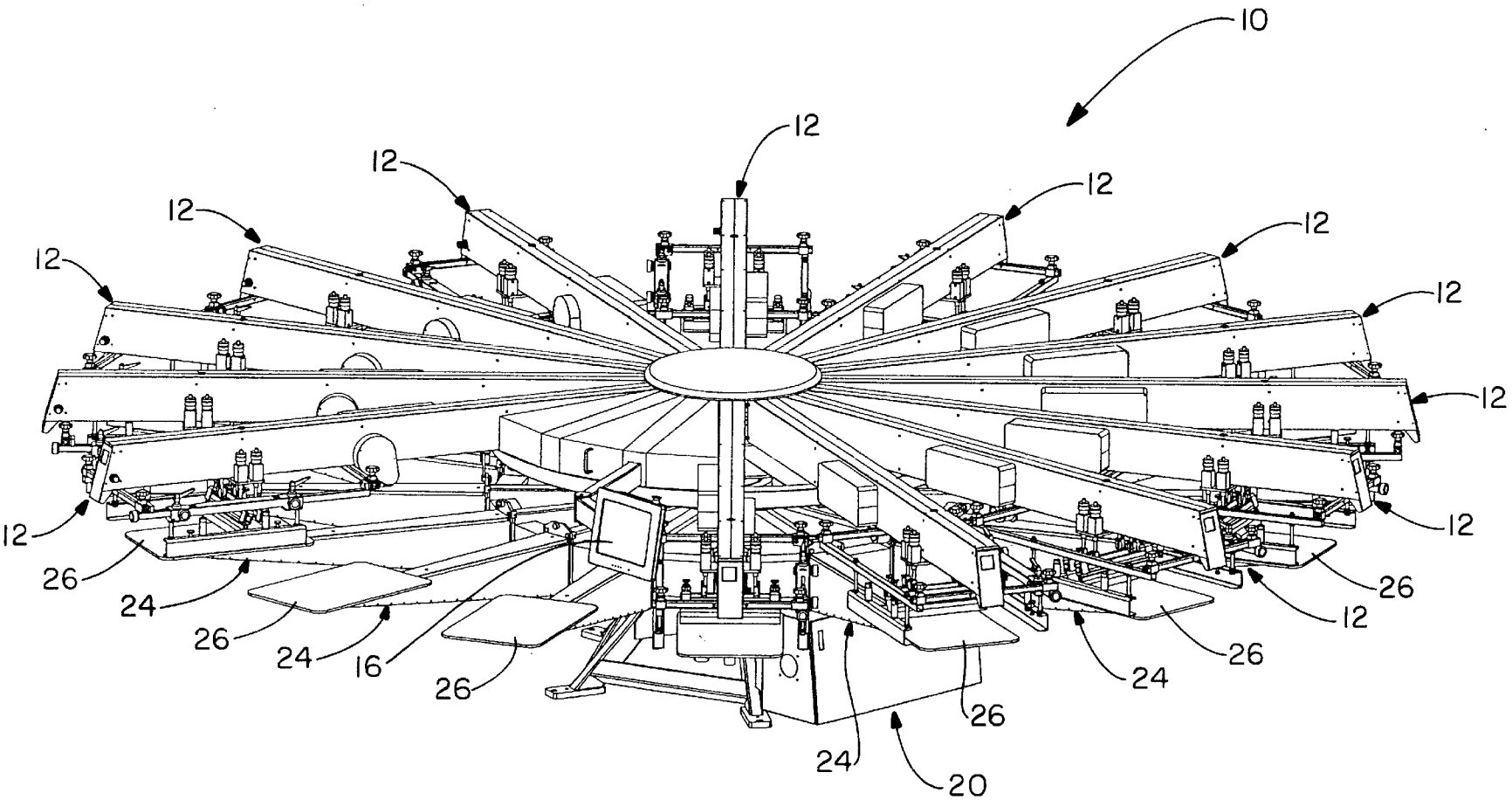
FIG. 2 is a second upper prospective view of the screen printing apparatus having a variable height print table arrangement for a screen printing apparatus in accordance with the preferred embodiment of the present invention shown in FIG. 1.
Figure 3:
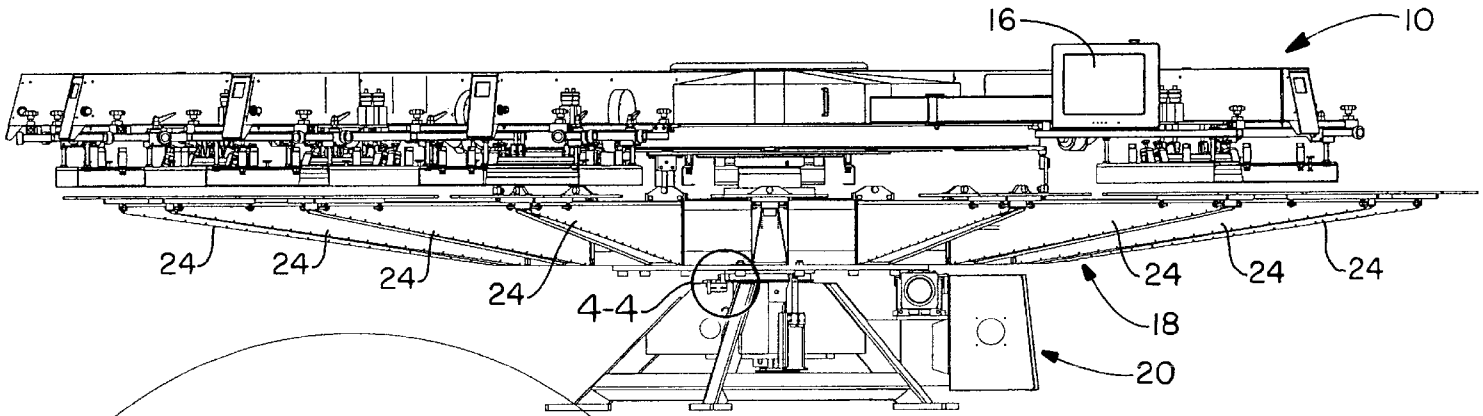
FIG. 3 is a front elevational view of the screen printing apparatus having a variable height print table arrangement for a screen printing apparatus in accordance with the preferred embodiment of the present invention shown in FIG. 1.

In the following detailed description of a preferred embodiment of the present invention, reference is made to the accompanying drawings which, in conjunction with this detailed description, illustrate and describe a preferred embodiment of a variable height print table arrangement for a screen printing apparatus in accordance with the present invention. Referring first to FIGS. 1 through 3, which show a first upper prospective view of a screen printing apparatus having a variable height print table arrangement for a screen printing apparatus in accordance with a preferred embodiment of the present invention, a second upper prospective view of the screen printing apparatus having a variable height print table arrangement for a screen printing apparatus in accordance with the preferred embodiment of the present invention shown in FIG. 1 and a front elevational view of the screen printing apparatus having a variable height print table arrangement for a screen printing apparatus in accordance with the preferred embodiment of the present invention shown in FIG. 1, respectively, screen printing apparatus is generally identified by reference number 10. Screen printing apparatus 10 includes a plurality of upper level stationary outwardly extending spider arms or stations 12, nine (9) of which are shown in FIG. 1, the others having been removed for clarity. Upper level stationary outwardly extending spider arms or stations 12 are selectively used as printing station(s), curing station(s), loading station(s) unloading station(s) or not used at all, as desired, for the particular screen printing operation to be accomplished. Upper level stationary outwardly extending spider arms or stations 12 are mounted to wheel 14 to set up the appropriate printing, curing, loading, unloading and inactive stations for the screen printing operation to be accomplished. In addition, screen printing apparatus 10 includes monitor 16, as well as various controls, to program and carry out screen printing operations on apparel and other textile substrates.

Figure 7:
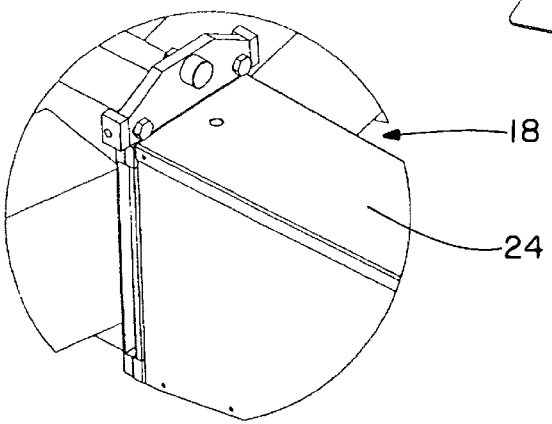
FIG. 7 is a detail view of the base and print table for a screen printing apparatus having a variable height print table arrangement for a screen printing apparatus in accordance with the preferred embodiment of the present invention shown in FIG. 1 taken from circle 7—7 in FIG. 6.
Figure 8:
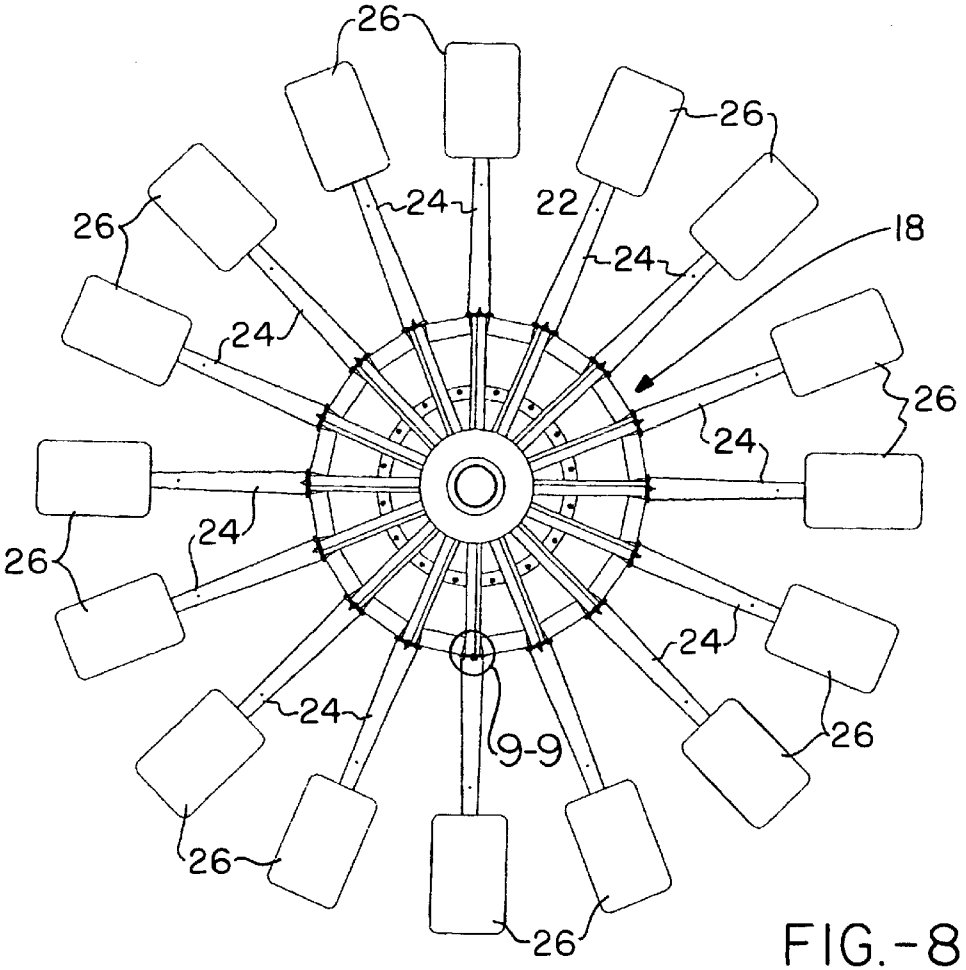
FIG. 8 is a top plan view of the print table for a screen printing apparatus having a variable height print table arrangement for a screen printing apparatus in accordance with the preferred embodiment of the present invention shown in FIG. 1.
Figure 9:
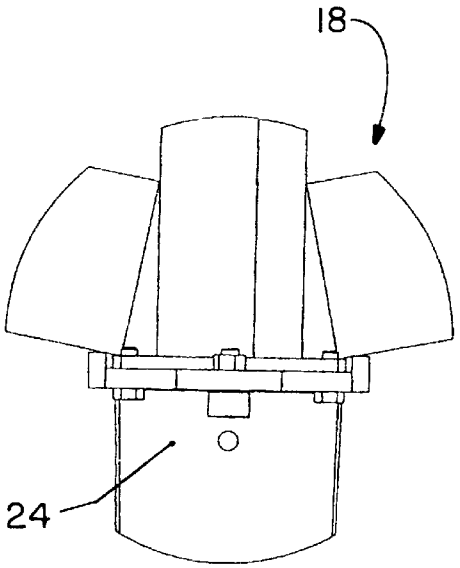
FIG. 9 is a detail view of the print table for a screen printing apparatus having a variable height print table arrangement for a screen printing apparatus in accordance with the preferred embodiment of the present invention shown in FIG. 1 taken from circle 9—9 in FIG. 8.
Figure 10:
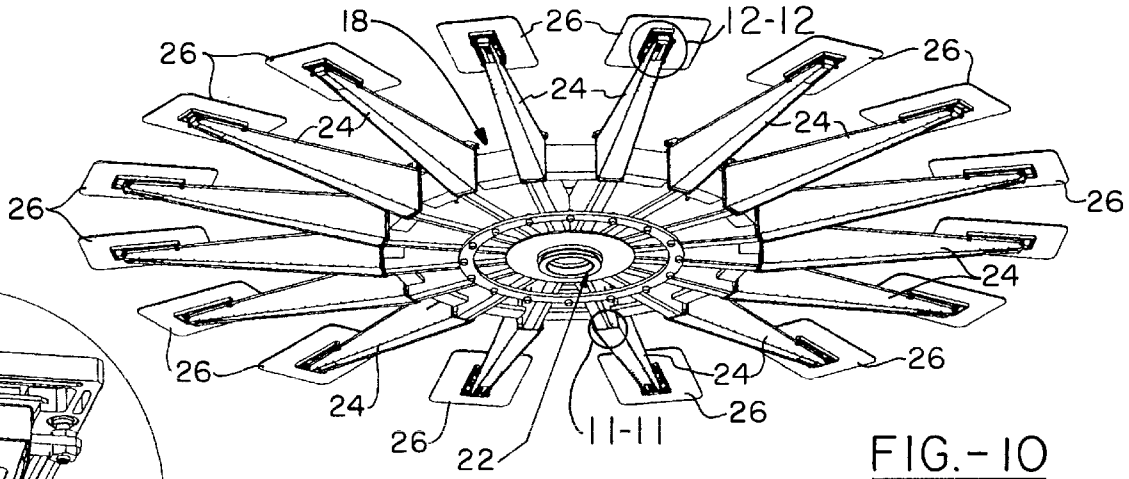
FIG. 10 is a lower prospective view of the print table for a screen printing apparatus having a variable height print table arrangement for a screen printing apparatus in accordance with the preferred embodiment of the present invention shown in FIG. 1.
Figure 12:
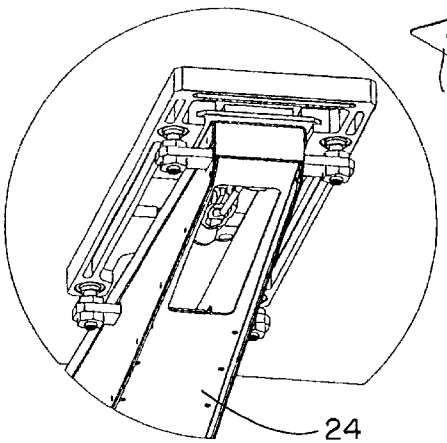
FIG. 12 is a detail view of the print table for a screen printing apparatus having a variable height print table arrangement for a screen printing apparatus in accordance with the preferred embodiment of the present invention shown in FIG. 1 taken from circle 12—12 in FIG. 10.
Figure 11:
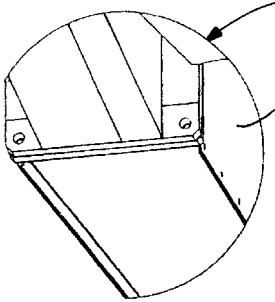
FIG. 11 is a detail view of the print table for a screen printing apparatus having a variable height print table arrangement for a screen printing apparatus in accordance with the preferred embodiment of the present invention shown in FIG. 1 taken from circle 11—11 in FIG. 10.

Referring to FIGS. 5 through 12, screen printing apparatus 10 also includes print table 18 which is positioned on base assembly 20. Print table 18 includes print table hub 22 and a plurality of lower level rotatable outwardly extending spider arms 24 extending outwardly from print table hub 22. Each of the plurality of lower level rotatable outwardly extending spider arms 24 preferably has support pallet or table 26 mounted on an outward portion thereof to support the apparel or other textile substrates to be screen printed. As seen in FIGS. 7, 9 and 11, lower level rotatable outwardly extending spider arms 24 are preferably attached to print table 18 by one or more removable mechanical fasteners, although other fastener arrangements could be utilized if desired, or lower level rotatable outwardly extending spider arms 24 and print table 18 could be fabricated as an integral one-piece component, if desired. Similarly, as seen in FIG. 12, support pallet or table 24 is preferably attached to an outward portion of lower level rotatable outwardly extending spider arms 24 by one or more removable mechanical fasteners, although other fastener arrangements could be utilized, if desired, or support pallet or table 26 and lower level rotatable outwardly extending spider arms 24 could be fabricated as an integral one-piece component, if desired.

Figure 13:
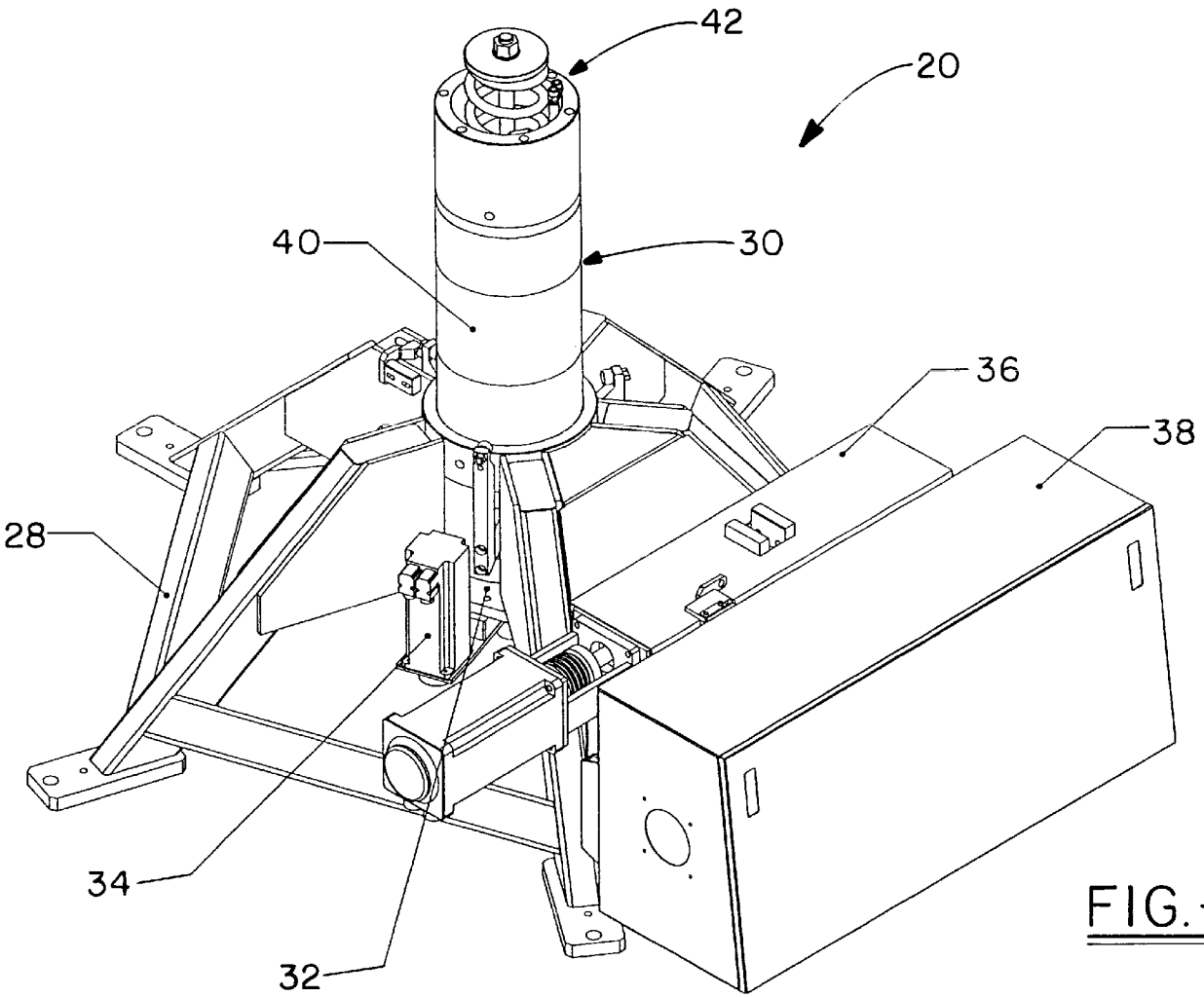
FIG. 13 is an upper prospective view of the base assembly for a screen printing apparatus having a variable height print table arrangement for a screen printing apparatus in accordance with the preferred embodiment of the present invention shown in FIG. 1.
Figure 14:
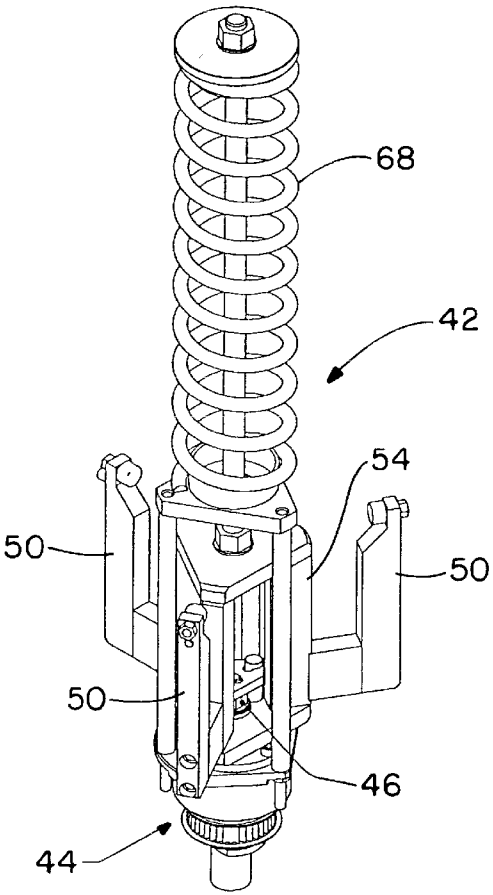
FIG. 14 is an upper prospective view of the print table lift assembly for a screen printing apparatus having a variable height print table arrangement for a screen printing apparatus in accordance with the preferred embodiment of the present invention shown in FIG. 1.
Figure 15:
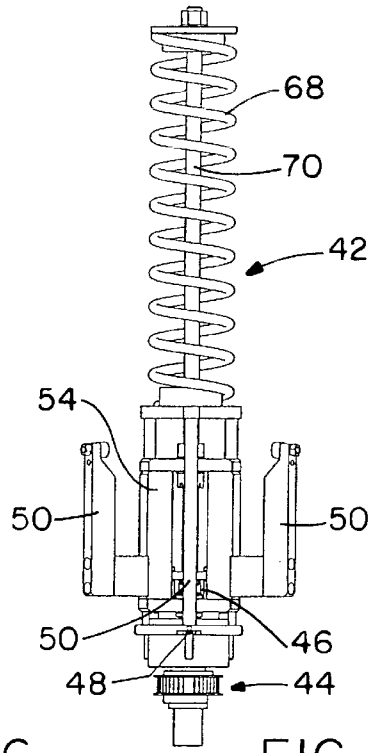
FIG. 15 is a first side elevational view of the print table lift assembly for a screen printing apparatus having a variable height print table arrangement for a screen printing apparatus in accordance with the preferred embodiment of the present invention shown in FIG. 1.
Figure 16:
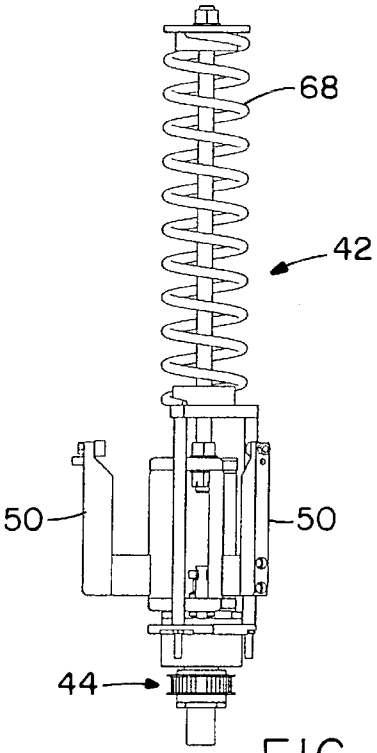
FIG. 16 is a second side elevational view of the print table lift assembly for a screen printing apparatus having a variable height print table arrangement for a screen printing apparatus in accordance with the preferred embodiment of the present invention shown in FIG. 1.
Figure 17:
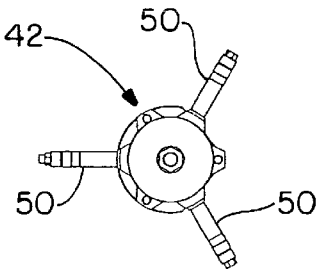
FIG. 17 is a top plan view of the print table lift assembly for a screen printing apparatus having a variable height print table arrangement for a screen printing apparatus in accordance with the preferred embodiment of the present invention shown in FIG. 1.
Figure 18:
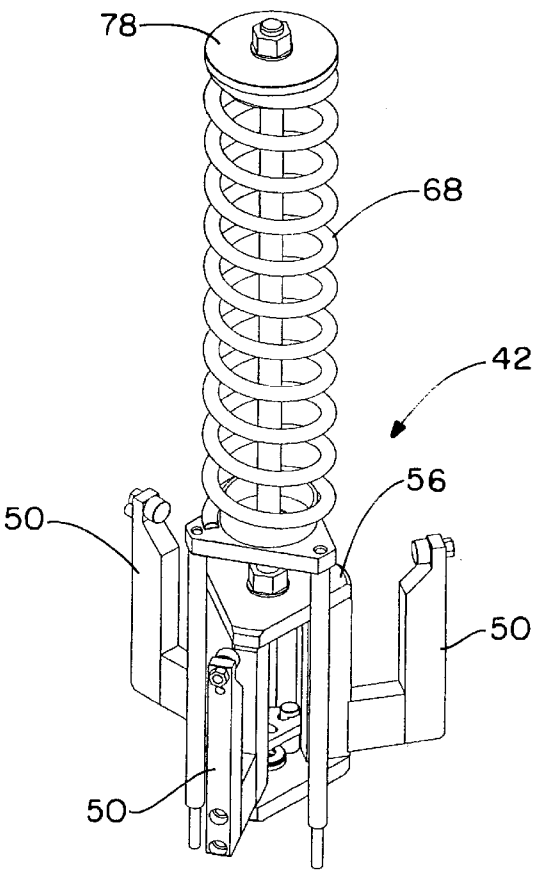
FIG. 18 is an upper prospective view of the balancing suspension assembly for a screen printing apparatus having a variable height print table arrangement for a screen printing apparatus in accordance with the preferred embodiment of the present invention shown in FIG. 1.
Figure 19:
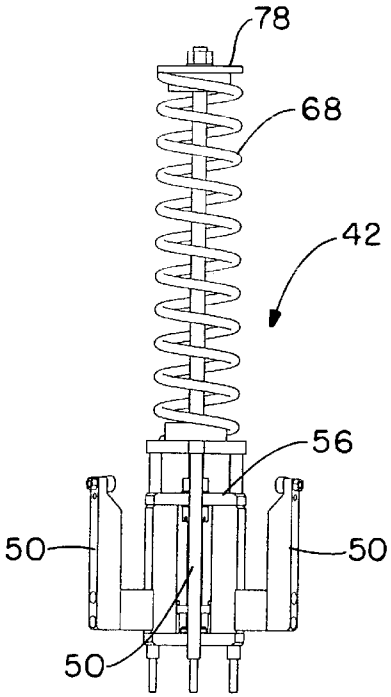
FIG. 19 is a first side elevational view of the balancing suspension assembly for a screen printing apparatus having a variable height print table arrangement for a screen printing apparatus in accordance with the preferred embodiment of the present invention shown in FIG. 1.
Figure 20:
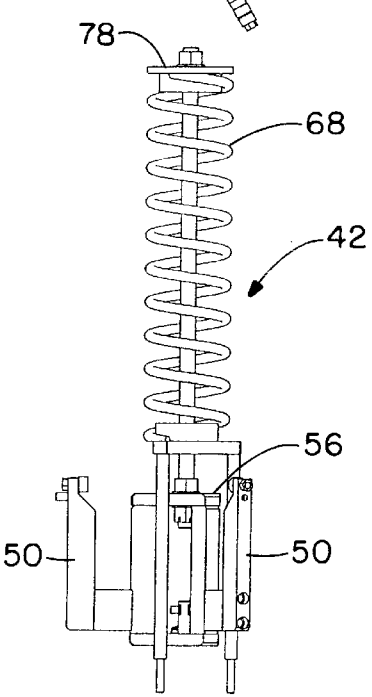
FIG. 20 is a second side elevational view of the balancing suspension assembly for a screen printing apparatus having a variable height print table arrangement for a screen printing apparatus in accordance with the preferred embodiment of the present invention shown in FIG. 1.
Figure 21:
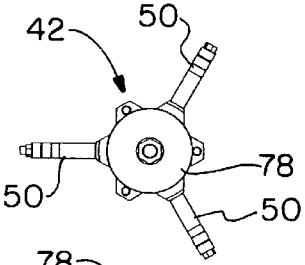
FIG. 21 is a top plan view of the balancing suspension assembly for a screen printing apparatus having a variable height print table arrangement for a screen printing apparatus in accordance with the preferred embodiment of the present invention shown in FIG. 1.

Referring to FIG. 13, base assembly 20 includes base 28, which supports print table lift assembly 30. Base 28 also supports main fixing plate 32, lift motor 34, indexer 36, electrical box 38 and column 40. Referring to FIGS. 14 through 17, print table lift assembly 30 generally includes balancing suspension assembly 42 and ball screw mechanism 44. Slotted hex nut 46 and fixing nut 48 removably join balancing suspension assembly 42 and ball screw mechanism 44 together and print table lift assembly 30 is positioned inside column 40.

Figure 4:
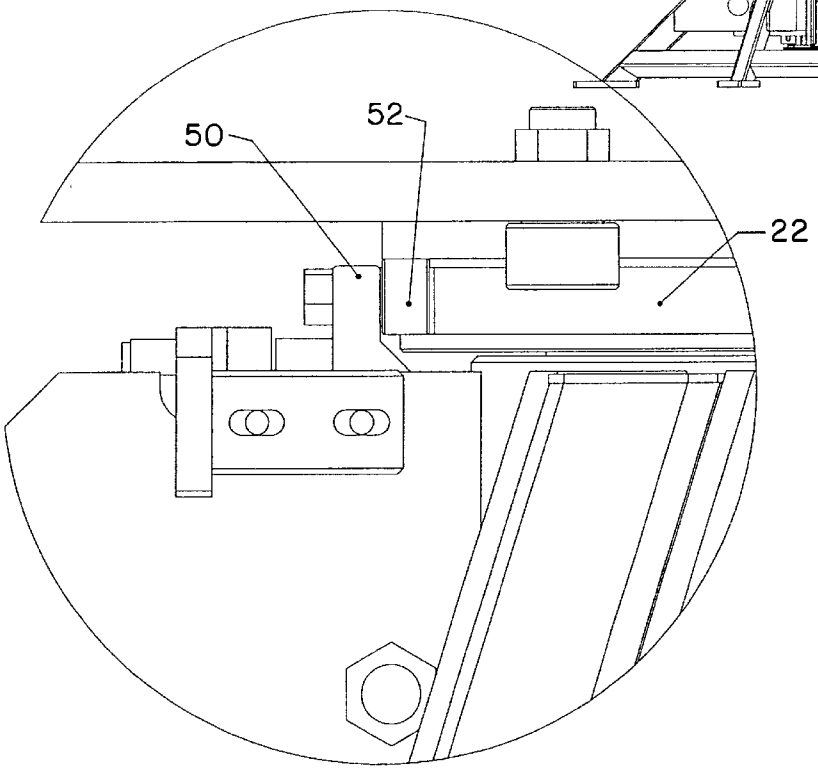
FIG. 4 is a detail view of the screen printing apparatus having a variable height print table arrangement for a screen printing apparatus in accordance with the preferred embodiment of the present invention shown in FIG. 1 taken from circle 4—4 in FIG. 3.
Figure 5:
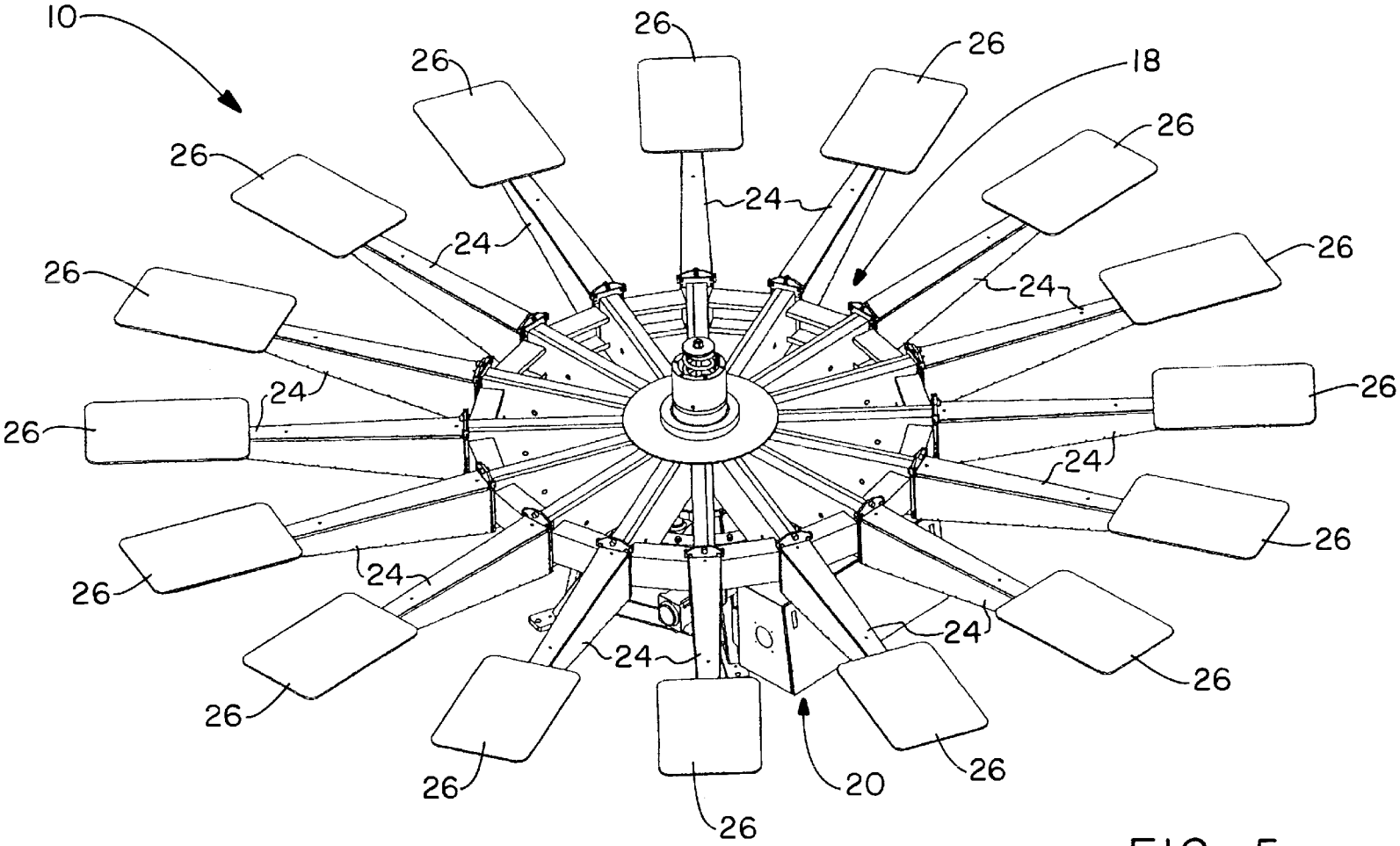
FIG. 5 is an upper prospective view of the base and print table for a screen printing apparatus having a variable height print table arrangement for a screen printing apparatus in accordance with the preferred embodiment of the present invention shown in FIG. 1.
Figure 6:
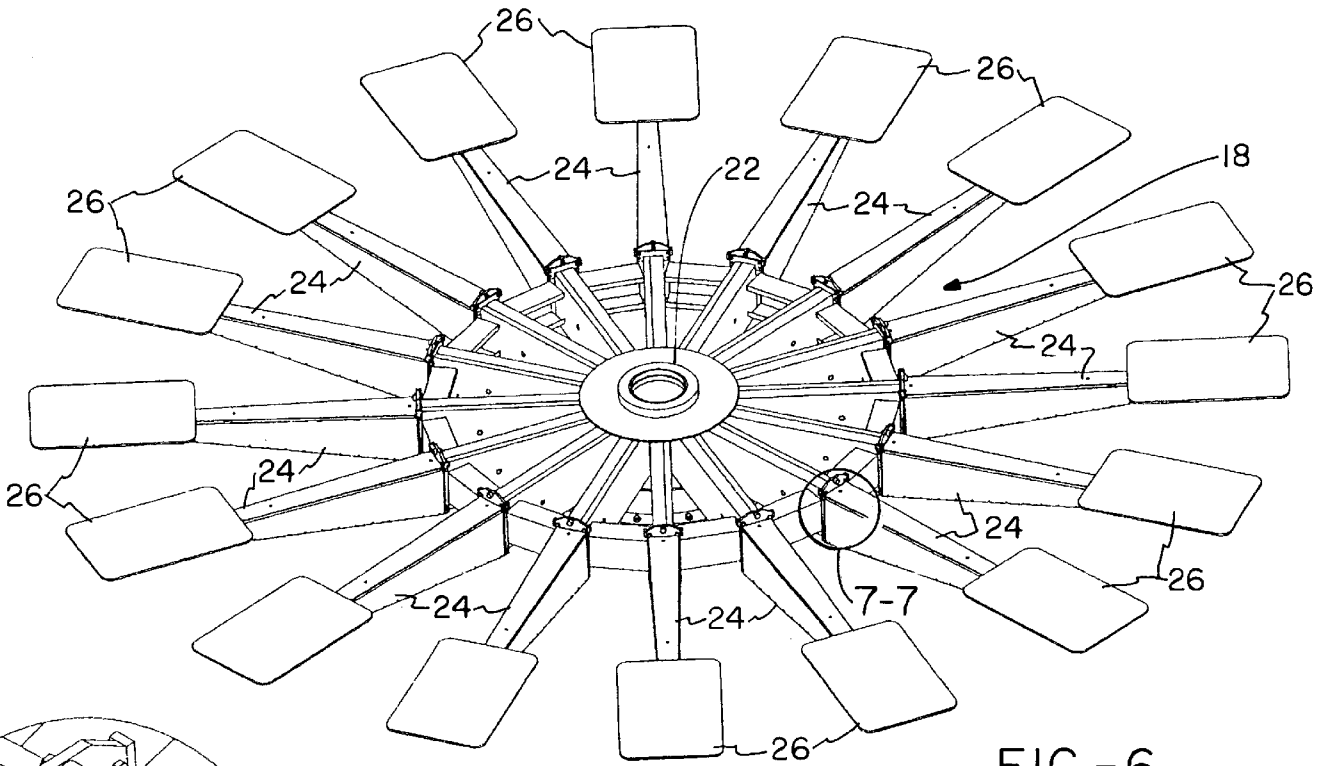
FIG. 6 is an upper prospective view of the base and print table for a screen printing apparatus having a variable height print table arrangement for a screen printing apparatus in accordance with the preferred embodiment of the present invention shown in FIG. 1.
Figure 22:
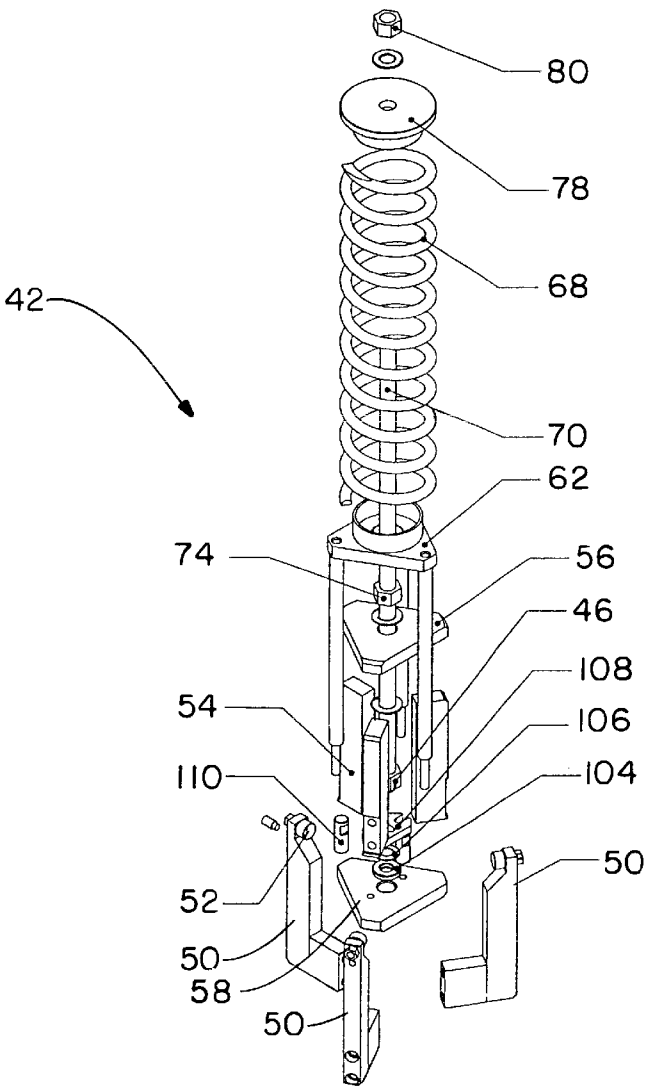
FIG. 22 is an upper exploded prospective view of the balancing suspension assembly for a screen printing apparatus having a variable height print table arrangement for a screen printing apparatus in accordance with the preferred embodiment of the present invention shown in FIG. 1.

Print table 18 is mounted through a set of bearings on column 40 and thus print table 18 is able to rotate in relation to column 40. In addition, print table 18 is vertically lowered and raised by print table lift assembly 30. Column 40 includes three (3) slots from which three (3) lift legs 50 outwardly protrude. As seen in FIGS. 4 and 22, each of the three (3) lift legs 50 is equipped with bearing 52, such as a needle roller bearing, at its distal end and is mounted with one or more mechanical fasteners, such as two (2) screws, to joining bar 54. Joining bars 54 are mounted to top balance bracket plate 56 and bottom balance bracket 58.

Figure 23:
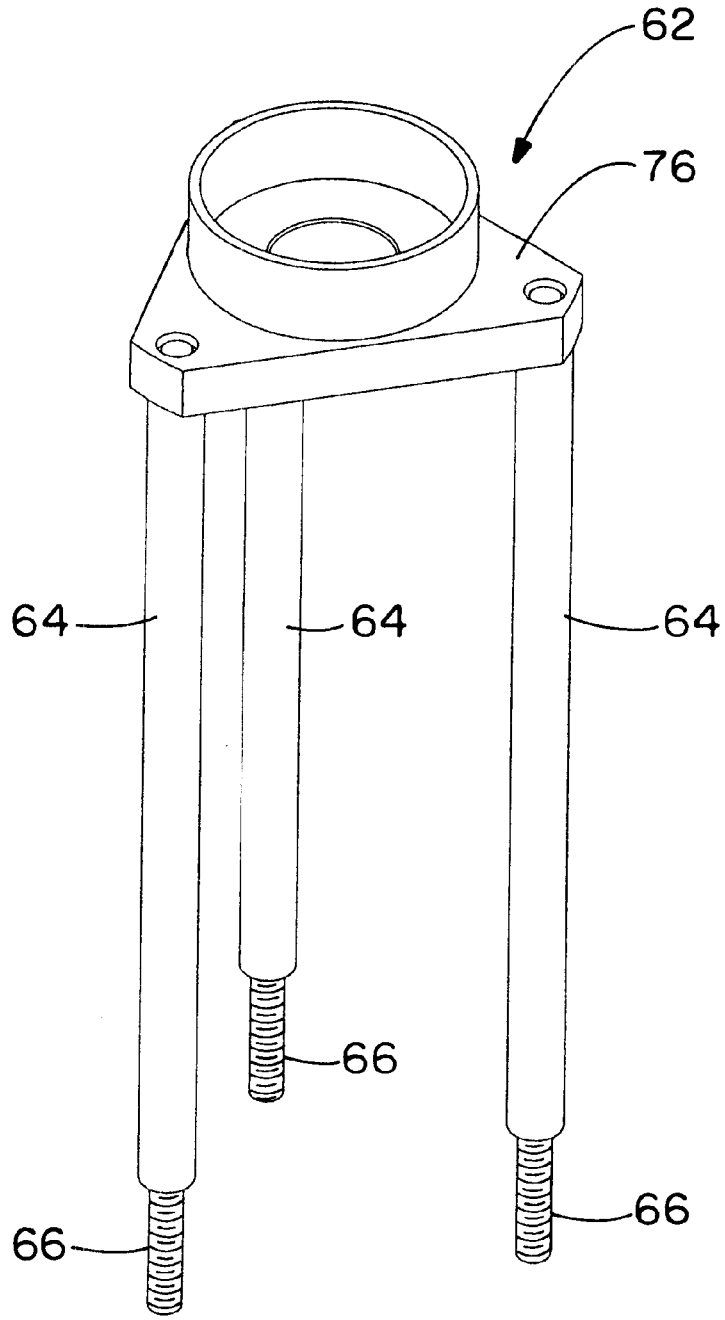
FIG. 23 is an upper prospective view of the balance spring support for a screen printing apparatus having a variable height print table arrangement for a screen printing apparatus in accordance with the preferred embodiment of the present invention shown in FIG. 1.
Figure 24:
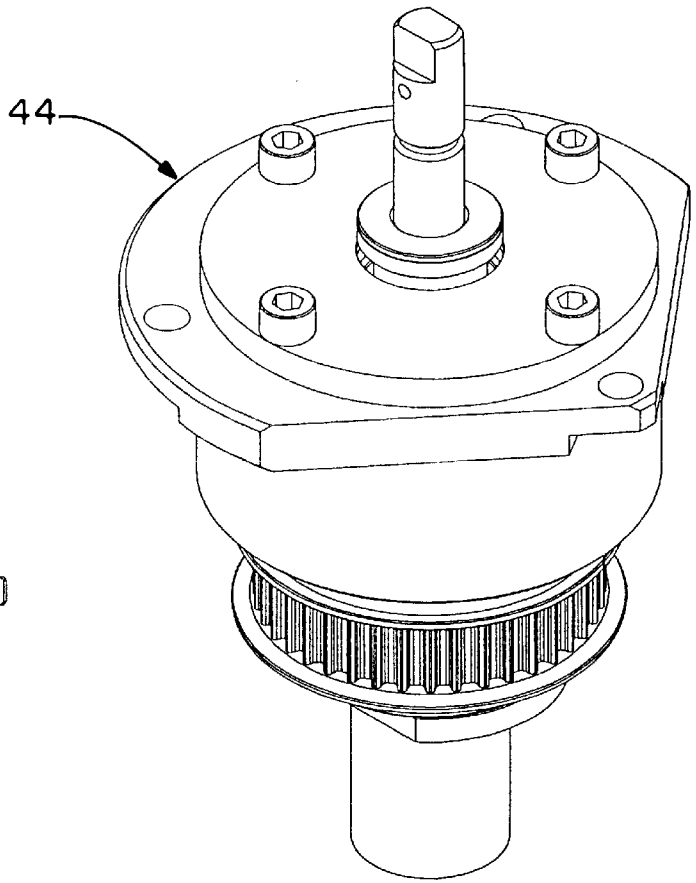
FIG. 24 is an upper prospective view of the ball screw mechanism for a screen printing apparatus having a variable height print table arrangement for a screen printing apparatus in accordance with the preferred embodiment of the present invention shown in FIG. 1.
Figure 25:
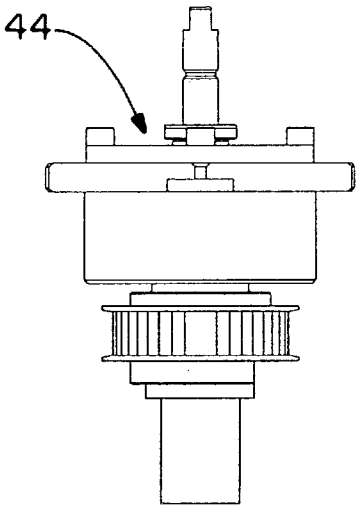
FIG. 25 is a first side elevational view of the ball screw mechanism for a screen printing apparatus having a variable height print table arrangement for a screen printing apparatus in accordance with the preferred embodiment of the present invention shown in FIG. 1.
Figure 26:
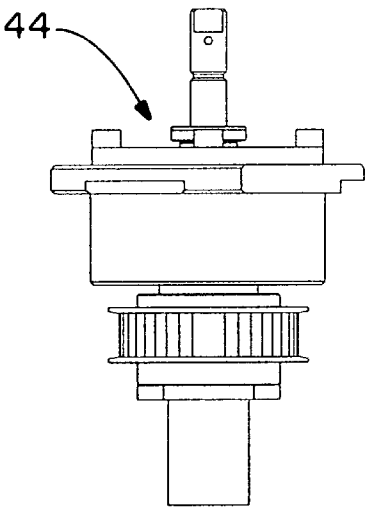
FIG. 26 is a second side elevational view of the ball screw mechanism for a screen printing apparatus having a variable height print table arrangement for a screen printing apparatus in accordance with the preferred embodiment of the present invention shown in FIG. 1.
Figure 27:
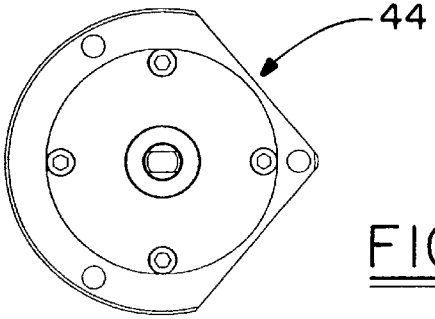
FIG. 27 is a top plan view of the ball screw mechanism for a screen printing apparatus having a variable height print table arrangement for a screen printing apparatus in accordance with the preferred embodiment of the present invention shown in FIG. 1.

Balancing suspension assembly 42 is located between bearing hub 60 and balance spring support 62 and are tied by a plurality of fixing rods 64, three (3) such fixing rods 64 being shown in FIG. 23, each fixing rod 64 having threaded portion or threaded rod 66.

Referring to FIG. 4, print table hub 22 of print table 18 includes bearings 52, such as needle roller bearings of the "CamRoll" type, which are positioned within an outer diameter groove. A working play within the groove is provided for bearings 52 to properly function. Print table lift assembly 30, as well as column 40, is mounted to main fixing plate 32 of base 28.

The purpose of balancing, suspension assembly 42 is to counterbalance the mass of print table 18. This is preferably achieved by utilizing balance spring 68 which is supported by balance spring support 62 mounted to the flange of bearing hub 60 by fixing rods 64, such as the three (3) fixing rods 64 shown in FIG. 23. Fixing rods 64 protrude through openings within main fixing plate 32 and are secured from the bottom with one or more mechanical fasteners, such as nuts. Spring tensioner screw 70 is mounted from the bottom to top balance bracket plate 56 and protrudes through the length of balance spring 68. Slotted hex nut 46 is used to secure spring tensioner screw 70 to top balance bracket plate 56 and mechanical fastener 74, such as a conventional nut, is preferably used from the top of top balance bracket plate 56.

Figure 28:
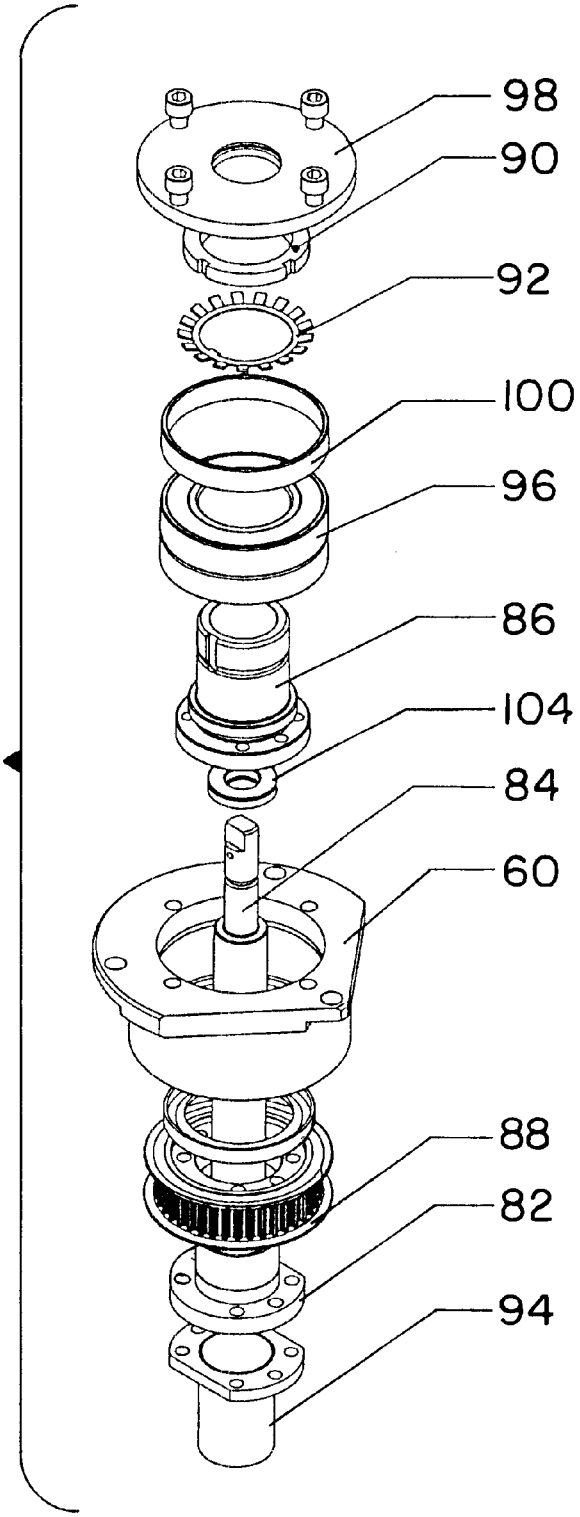
FIG. 28 is an upper exploded prospective view of the ball screw mechanism for a screen printing apparatus having a variable height print table arrangement for a screen printing apparatus in accordance with the preferred embodiment of the present invention shown in FIG. 1.

Balance spring 68 rests on support plate 76 of balance spring support 62. The compression force of balance spring 68 is adjustable by the rotation of spring tensioner screw 70 acting through balance spring tensioner 78. Spring tensioner screw 70 is preferably secured with mechanical fastener 80, such as a nut, on top of balance spring 68. Vertical up and down motion is preferably actuated by lift motor 34, such as an electrical servometer or an electrical stepper motor, which drives ball nut 82 of lift ball screw or lead screw 84 through a belt reduction system. (See FIG. 28) Ball nut 82 is mounted to sleeve bushing 86 through a cogged belt sprocket or belt pulley 88. Sleeve bushing 86 supports lift ball screw or lead screw 84 by an internal set of roller bearings, such as tapered roller bearings, and the bearing races are mounted within sleeve bushing 86 by bearing nut or lock nut 90 and secured by serrated washer or lock washer 92. Ball nut 82, when rotated, actuates the vertical motion of lift ball screw or lead screw 84. Oil reservoir or oil tank 94 is mounted to the bottom of ball nut 82 to provide lubrication for ball nut 82. During rotary motion of ball nut 82, lubricating oil travels from oil reservoir or oil tank 94 upward along lift ball screw or lead screw 84 to provide lubrication for bearings 96, such as tapered roller bearings. When rotation of ball nut 82 stops, lubricating oil returns to oil reservoir or oil tank 94 through internal channels drilled through sleeve bushing 86.

Lift ball screw or lead screw 84 protrudes from the top through bearing hub cover or top plate 98. Bearing hub cover or top plate 98 also locates bearings 96, such as tapered roller bearings, axially by spacer ring or distance ring 100. One end of lift ball screw or lead screw 84 is mounted to bottom balance bracket plate 58 through, for example, a set of two (2) spherical washers 104. This spherical washer assembly provides compensation for axial and perpendicular misalignment of bottom balance bracket 58 relative to lift ball screw or lead screw 84. The compression of spherical washers 104 is controlled by belleville disc spring 106 tightened by slotted hex nut 46 which is then secured by a detent pin. To prevent rotation of lift ball screw or lead screw 84, a flat-machined end of lift ball screw or lead screw 84 is located by ball screw stop plate 108 mounted to bottom balance bracket 58. Ball screw stop plate 108 is preferably located by two (2) dowels or stop shafts 110 within bottom balance bracket 58.

The operation of balancing suspension assembly 42 in accordance with the present invention will now be described. Print table hub 22 of print table 18 is positioned upon lift legs 50 and thus lift legs 50 support the weight of print table 18. Lift legs 50 are connected to spring tensioner screw 70 which extends the entire length of balance spring 68. Spring tensioner screw 70 has balance spring tensioner 78 adjustably attached at its upward end and captures balance spring 68 between balance spring tensioner 78 and balance spring support 62. Thus, the weight of print table 18 moves lift legs 50 and thus balance spring tensioner 78 downward which compresses balance spring 68. Mechanical fastener 80 permits adjustment of the extent of compression of balance spring 68 when lower level rotatable outwardly extending spider arms 24, and thus print table 18, is in its downward position. When lower level rotatable outwardly extending spider arms 24, and thus print table 18, are moved upwardly by lift motor 34, the length of balance spring 68 increases, thus reducing the effective weight of print table 18 to lift motor 34. This allows a smaller, and thus less expensive, lift motor 34 to be used, if desired, or allows a lift motor of the same size to move print table more quickly. When lower level rotatable outwardly extending spider arms 24, and thus print table 18, are moved downward, additional force is needed to shorten and compress balance spring 68. However, in this case, gravitational force and the weight of print table 18 assist in shortening and compressing balance spring 68. Accordingly, the counterbalance arrangement for screen printing apparatus 10 in accordance with the present invention utilizes energy stored in a compressed balance spring 68, such as a coil spring, to assist lift motor 34 in the upward movement of lower level rotatable outwardly extending spider arms 24 and print table 18. In addition, balance spring 68 is shortened and compressed when lower lever rotatable outwardly extending spider arms 24 and print table 18 is moved downwardly using, at least in part, the weight of print table 18 and gravitational force to assist in shortening and compressing balance spring 68.

The use of a mechanical drive, such as an electrical servomotor or an electrical stepper motor, for lift motor 34 allows the upwardmost position or "stop," the lowermost position or "stop" and the length of movement or "stroke" of support pallets or tables to be readily adjusted. This would allow the upwardmost position or "stop" to be adjusted to, for example, accommodate inks having different characteristics, such as different densities or compositions, apparel or textile substrates having different characteristics, such as different absorbencies and printing screen having different characteristics, such as printing screens of different sizes, flexibility and rigidity. In addition, it is sometimes desirable to utilize a partial stroke to break contact between support pallets or tables 26 and upper level stationary outwardly extending spider arms or stations 12 without indexing support pallets or tables 26 to the next station. This can be readily accommodated using a mechanical drive, such as an electrical servomotor or electrical step motor, in accordance with the present invention.

Thus, screen printing apparatus 10 in accordance with the present invention utilizes a mechanical drive rather than one or more air cylinders to lower and raise support pallets or tables 26. The use of such a mechanical drive generally provides more accurate control and positioning of support pallets or tables 26 and also permits support pallets or tables 26 to be positioned at specific uppermost and/or lowermost positions or "stops" and lowered a predetermined variable distance. This is beneficial and can save cycle time, particularly in those instances where support pallets or tables 26 are not indexed to the next station, but remain at the same station for subsequent operation(s). In addition, balancing suspension assembly 42 is adjustable and reduces the effective weight of print table 18. Accordingly, lift motor 34 can be smaller than what would otherwise be needed and this, in turn, reduces the size, weight and cost of lift motor 34.

Accordingly, although the present invention has been described above in detail, the same is by way of illustration and example only and is not to be taken as a limitation on the present invention. It is apparent to those having a level of ordinary skill in the relevant art that other variations and modifications in variable height print table arrangement for a screen printing apparatus in accordance with the present invention, as described and shown herein, could be readily made using the teachings of the present invention. For example, other counterbalance arrangements could be used, such as counterbalance weights, if desired. Accordingly, the scope and content of the present invention are to be defined only by the terms of the appended claims.

What is claimed is:

1. A screen printing apparatus, comprising:

plurality of outwardly extending upper level stationary arms;

a plurality of outwardly extending lower level rotatable spider arms positioned below and corresponding to the plurality of stationary arms;

a means for positioning the plurality of spider arms a predetermined vertical distance in relation to the plurality of stationary arms, the means for positioning comprising a single ball screw mechanism operatively connected to the plurality of spider arms; and an electrical motor drivingly engaging the ball screw mechanism; and a counterbalance mechanism to at least partially offset the weight of the plurality of spider arms, the counterbalance mechanism including an axially extending compression spring, wherein the compression spring is coaxial with an axis of rotation of the ball screw mechanism.

2. The screen printing apparatus according to claim 1, further comprising:

a balancing suspension assembly operatively connecting the ball screw mechanism and the counterbalance mechanism, the compression spring being attached to an upper end of the balancing suspension assembly and the ball screw mechanism being connected to a lower end of the balancing suspension assembly.

3. A screen printing apparatus, comprising:

a plurality of outwardly extending upper level stationary arms;

a plurality of outwardly extending lower level rotatable spider arms positioned below and corresponding to the plurality of stationary arms;

a means for positioning the plurality of spider arms a predetermined variable vertical distance in relation to the plurality of stationary arms, the means for positioning comprising a single ball screw mechanism operatively connected to the plurality of spider arms; and an electrical motor drivingly engaging the ball screw mechanism;

a counterbalance mechanism to at least partially offset the weight of the plurality of spider arms, the counterbalance mechanism including an axially extending compression spring coaxial with an axis of rotation of the ball screw mechanism; and a balancing suspension assembly operatively connecting the ball screw mechanism and the counterbalance mechanism, the compression spring being attached to an upper end of the balancing suspension assembly and the ball screw mechanism being connected to a lower end of the balancing suspension assembly.

4. The screen printing apparatus according to claim 3, wherein the electrical motor is an electrical servo motor.

5. The screen printing apparatus according to claim 3, wherein the electrical motor is an electrical stepper motor.

* * * * *